United States Patent [19]

Olson et al.

[11] Patent Number: 4,624,026

[45] Date of Patent: Nov. 25, 1986

[54] SURFACE MAINTENANCE MACHINE WITH ROTARY LIP

[75] Inventors: Donald L. Olson; Donald L. Thomsen, both of Minneapolis, Minn.

[73] Assignee: Tennant Company, Minneapolis, Minn.

[21] Appl. No.: 416,659

[22] Filed: Sep. 10, 1982

[51] Int. Cl.[4] ..... E01F 1/04; E01F 1/08

[52] U.S. Cl. ..... 15/340; 15/83

[58] Field of Search ..... 15/49 C, 50 C, 79, 79 A, 15/83, 84, 85, 86, 340

[56] References Cited

U.S. PATENT DOCUMENTS 2,054,713 9/1936 Randolph .

2,739,340 3/1956 Blydenburgh et al. .

3,824,645 7/1974 Krier et al. .

4,041,567 8/1977 Burgoon .

4,366,593 1/1983 Parikh .

*Primary Examiner*—Edward L. Roberts

*Attorney, Agent, or Firm*—Kinzer, Plyer, Dorn & McEachran

[57] ABSTRACT

A surface maintenance machine is disclosed including a body supported on a plurality of wheels and a power source for driving the wheels. The body carries a driven cylindrical brush and a powered rotary lip which cooperates with the brush to project dirt and debris into the hopper, each end of the rotary lip being supported for vertical movement.

16 Claims, 10 Drawing Figures

FIG. I
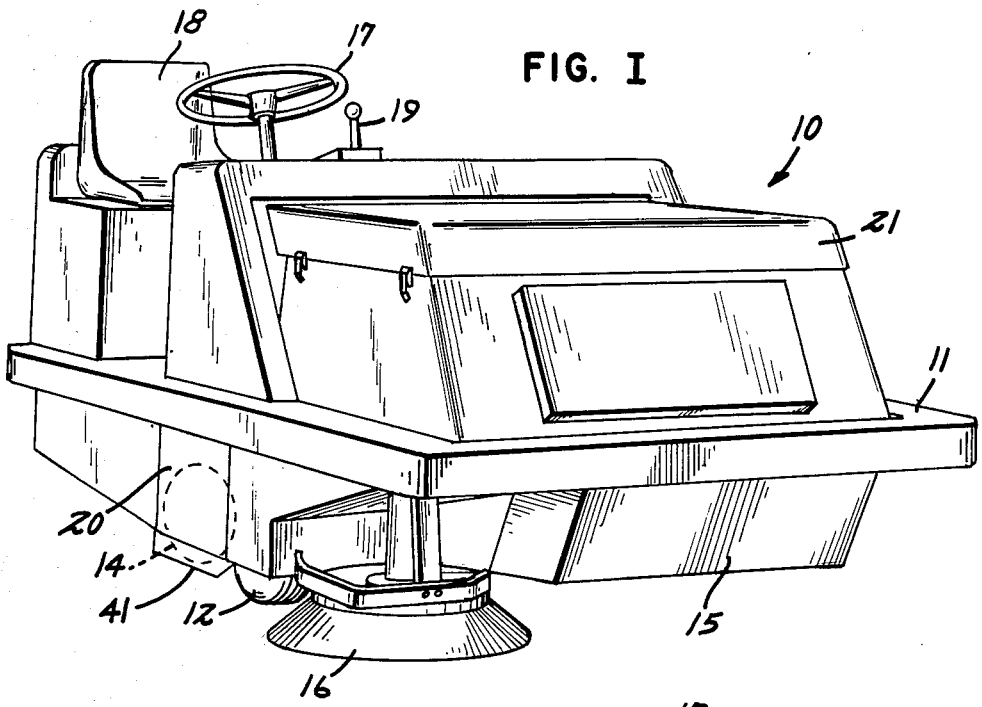
FIG. II
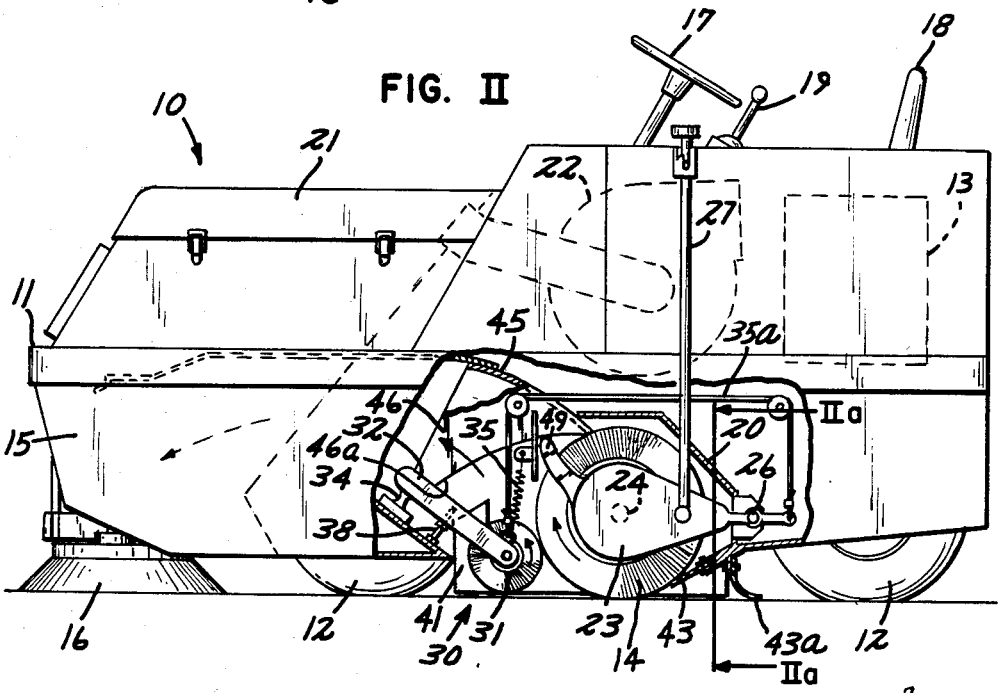
FIG. IIa
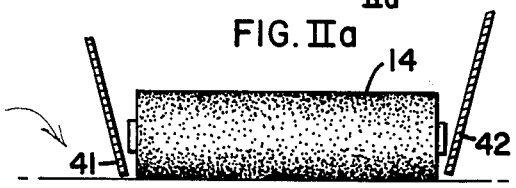

FIG. III
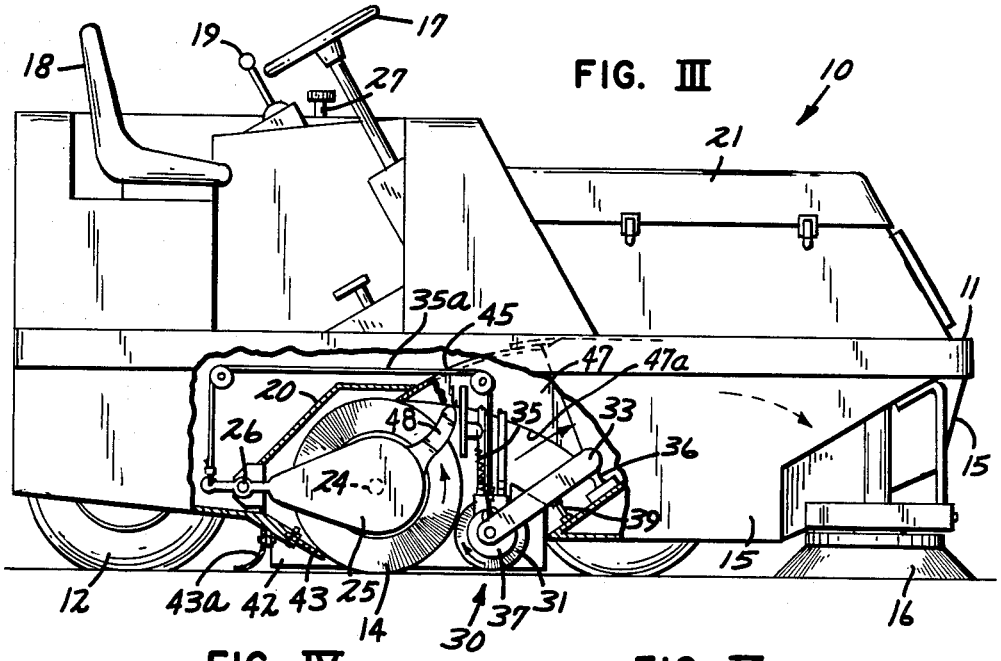
FIG. IV
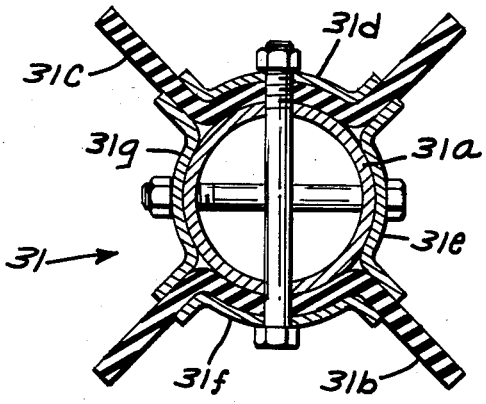
FIG. V
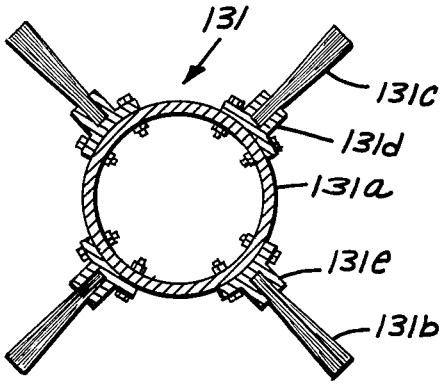
FIG. VI
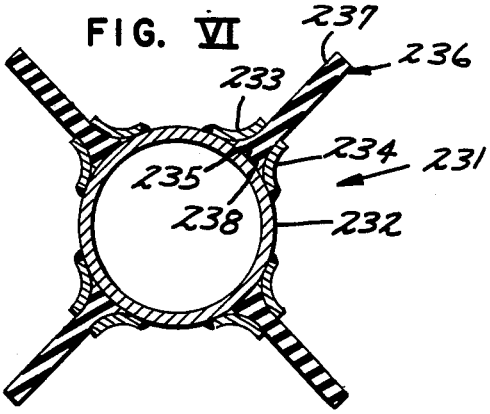

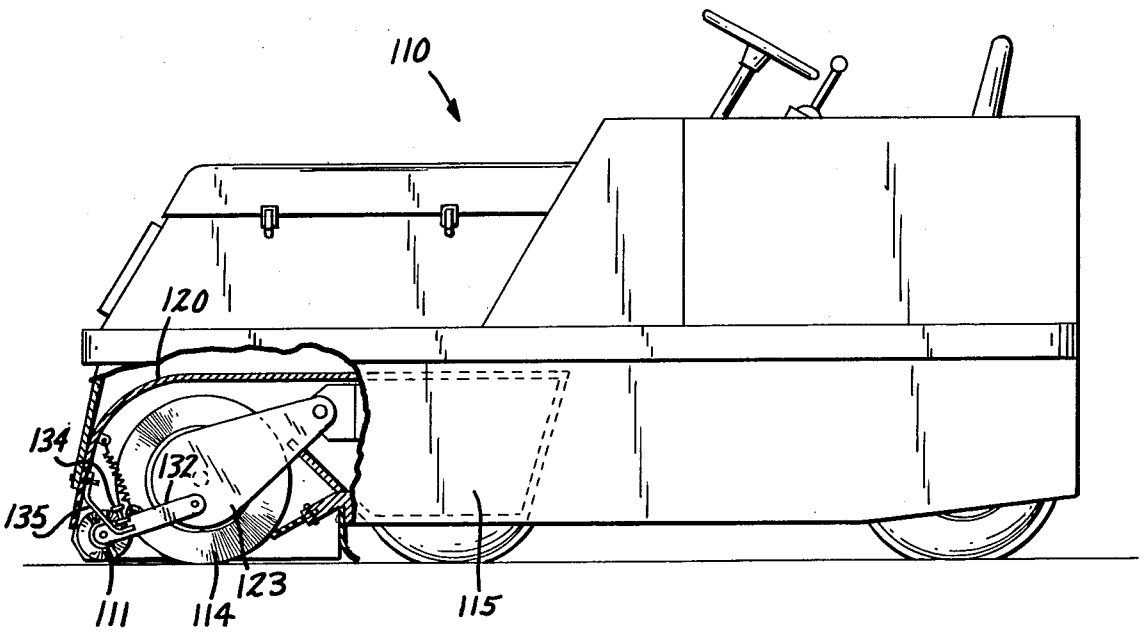
FIG. VII

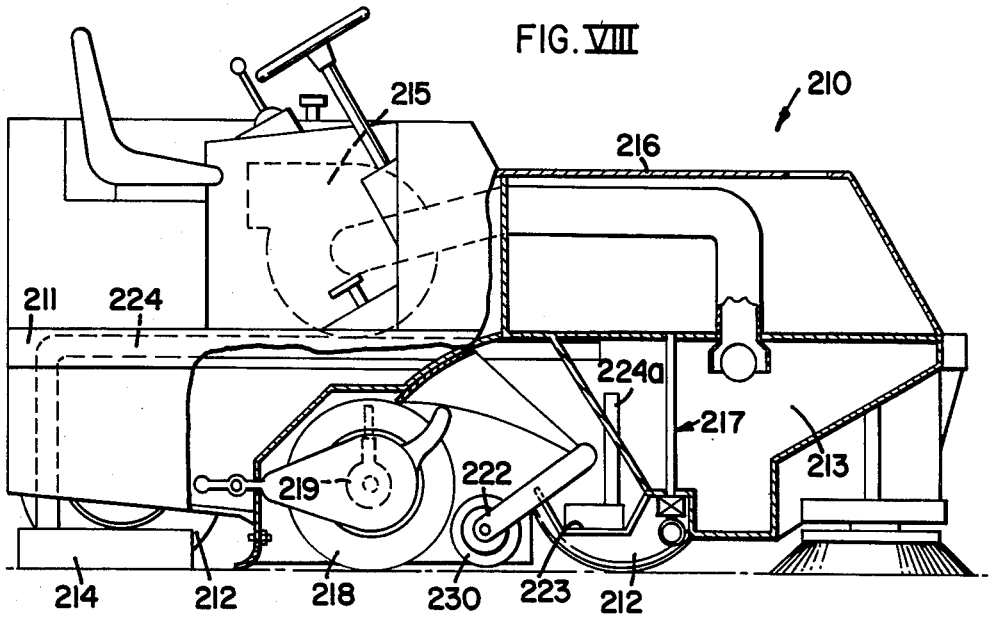
FIG. VIII
210
215
216
211
224
224a
217
213
219
222
214
212
218
230
223
212

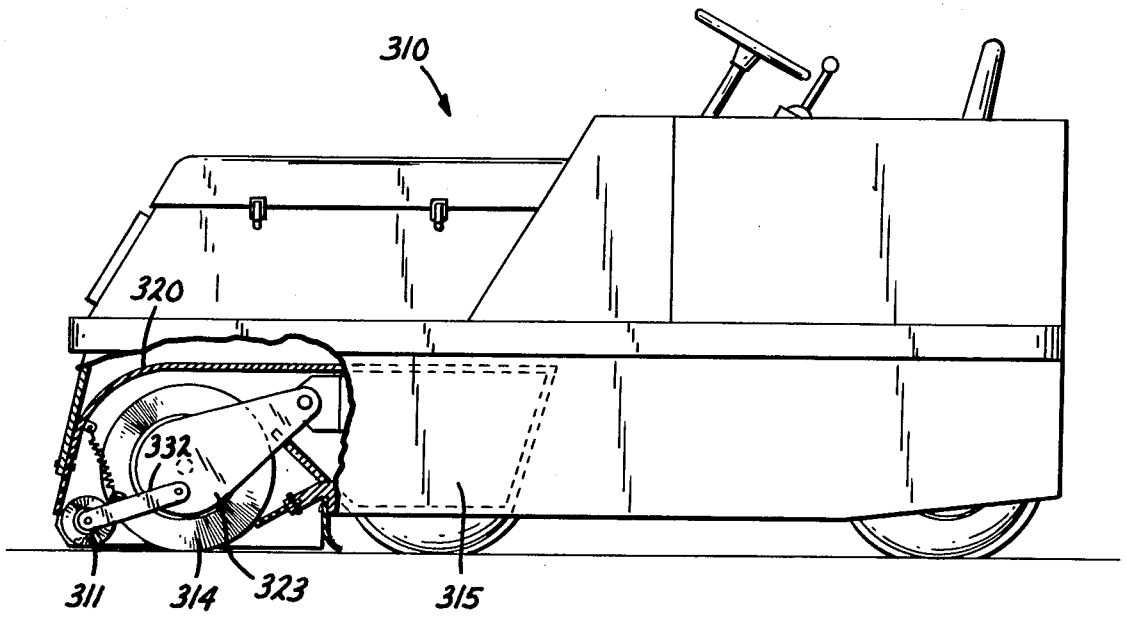
FIG. IX

SURFACE MAINTENANCE MACHINE WITH ROTARY LIP

BACKGROUND OF THE INVENTION

The present invention relates to surface maintenance machines and more particularly to such machines having cylindrically shaped tools which work to remove soilage and debris from the floor surface.

In the past, a variety of floor maintenance machines have been available which sweep and/or scrub a floor surface utilizing a cylindrical brush. As used herein the terms "surface", "floor surface", "maintained surface" and the like will be used to designate or represent those surfaces which require cleaning, such as the floors of buildings (e.g. warehouses), as well as the surfaces of outdoor facilities (e.g. turf, streets, sidewalks and parking lots) and also to designate or represent those surfaces which require scrubbing such as the floors of buildings (e.g. warehouses). Known floor maintenance machines may be either riding units or walk behind units. Sweepers generally include a hopper into which the powered cylindrical brush sweeps dirt and debris. The hopper is constructed in such a manner as to permit dumping of the dirt and debris when desired. Scrubbers generally include a smaller debris hopper into which the powered cylindrical brush or brushes sweep dirt and dirty scrub water. Scrubbers have suitable solution and recovery tanks. Scrubbers also have suitable vacuum squeegee mechanism for removing dirty scrub water from the floor surface and from the debris hopper, depositing such water in the recovery tank. Other surface maintenance machines are available, such as scarifying machines which use cylindrical tools.

Illustrative of power sweepers which utilize cylindrical brushes are the floor maintenance machines described in U.S. Pat. Nos. 3,189,931 (Peabody) and 3,304,572 (Wendel). These sweepers utilize a debris hopper having an attached rubber lip which flexes to admit debris to the sweeping chamber and drops back into place to block the passage therebeneath of debris swept forwardly by the brush. Scrubbing machines which utilize a cylindrical brush are illustrated in U.S. Pat. Nos. 3,197,798 (Brown et al.) and 3,702,488 (Kasper). The Tennant$^R$ Model 265 Power Sweeper (trademark of Tennant Company) and U.S. Pat. No. 3,197,798 are illustrative of units which are convertible from a sweeper which utilizes a cylindrical brush to a scrubbing machine which also utilizes a cylindrical brush. U.S. Pat. No. 3,702,488 shows a scrubbing machine which uses two driven brushes to work a scrubbing solution on the floor. The cylindrical brush or brushes of a scrubbing machine serve to work a scrubbing solution on a maintained surface to loosen soilage. The cylindrical scrubbing brush may also lift spent scrubbing solution, dirt and debris into a suitable tray or tank.

In the present invention, it was found advantageous on a floor maintenance machine, for example, a sweeper, to include a powered rotary lip for use in conjunction with the cylindrical brush. In a sweeper, the rotary lip serves to function performed by conventional lips and seals the forward side of the brush housing to assist in maintenance of the vacuum in the housing. The rotary lip permits movement of large debris such as cans and bottles therebeneath. This permits use of a more elevated hopper bottom, thus providing improved clearance and eliminating the need for a conventional rocking hopper (see U.S. Pat. No. 2,701,377) thereby simplifying the structure. By allowing more clearance under the hopper bottom, the rotary lip permits movement of large debris such as cans, bottles, rocks, and scrap lumber therebeneath, and tends to reduce or prevent pushing of such debris which is more of a problem with sweepers having a stationary flexible lip. The rotary lip also provides a more elevated projection of the debris. Because the rotary lip is powered, it also positively pulls debris into the sweeping chamber and feeds it to the sweeping brush. This makes it possible, on a machine with the hopper behind the main sweeping brush and with a relatively large rotary lip, to drive up to a pile or heavy accumulation of bulky debris and pull it into the machine and load it. Such an operation is highly desirable in many types of clean-up operations. The elevated projection also permits use of an inlet wall for the hopper e.g. four sided hopper, resulting in an increased useful volume for the hopper. The rotary lip assures a more complete filling of the sweeper hopper particularly when lightweight debris is being picked up. In other words, the rotary lip assists in projecting the lightweight debris well into the hopper. The rotary lip may serve as an impeller and create desirable air currents which act to move lightweight debris well into the hopper.

Use of the present powered rotary lip in a scrubber is advantageous since improved debris pickup is obtained and a significant portion of the dirty scrub water is also lifted thus reducing the load on the squeegee.

The present invention provides greater efficiency on lifting debris from the maintained surface. A problem encountered with conventional sweeping equipment is that lightweight debris such as paper and aluminum cans may accumulate immediately in front of the stationary flexible lip seal. This is especially a problem during operation on smooth floor surfaces. The present rotary lip overcomes this problem and draws such debris into the pick-up zone where the debris is thrown by the lip into contact with the brush at an elevated point on the brush, thereby facilitating movement of the debris into the hopper. The present invention also minimizes the effect of a common difficulty encountered in the past wherein debris has been projected forwardly beneath the front lip or skirt of the sweeping brush housing. The present rotary lip serves as a more effective seal than previous seals in retaining debris within the brush chamber. Known sweepers tend to lose sweeping efficiency as the brush becomes worn, whereas the present invention maintains a greater degree of efficiency throughout the brush wear life.

It has been known in the past to use a nonpowered rotatable lip seal to permit larger debris to reach the brush, for example, see U.S. Pat. Nos. 3,584,325 (Larson et al) and 3,513,498 (Bennich). The Larson et al patent has a flap-type lip seal which is rotated only when larger pieces of debris are encountered thereby permitting the larger debris to pass beneath the seal. In this case the rotatable lip does not assist to any significant extent in the projection of debris into the hopper. The Bennich patent shows a lip comprised of a tubular deflector mounted on an elongated rod. The tubular deflector is loosely mounted on the rod. In this case again the deflector does not assist to any significant extent in the projection of debris into a hopper. Rather the deflector prevents or minimizes projection of debris forwardly.

It has also been known in the past to use a pair of power-driven brushes, for example see U.S. Pat. No. 2,054,713 (Randolph). In this patent a larger power-driven brush is used in conjunction with a smaller powerdriven brush. The smaller brush is held in locked position in contact with the surface being swept and is prevented from moving vertically with respect to the larger brush, thereby preventing the entry of large debris items under the smaller brush. Various other counter-rotating dual brush sweepers have been known.

GENERAL DESCRIPTION OF THE PRESENT INVENTION

The present invention provides a floor maintenance machine such as a sweeper or scrubber including a power-driven rotating lip. The present floor maintenance machine includes a body structure which may be of a riding type or a walk behind type. The unit may include wheels and a suitable source of power such as an electric motor or a gasoline engine. The present machine has a primary cylindrical brush for lifting material such as debris, sand, litter and the like from a surface being swept or scrubbed for deposition in a container portion such as a conventional hopper. The hopper in the present unit may be a four-sided hopper with a short wall adjacent the brush to provide a greater effective hopper volume. The machine has a powered rotary lip which assists the principal cylindrical brush in projecting the material into the hopper. The rotary lip may be a multi-vaned cylinder or a secondary (e.g. smaller, equal or larger in size) cylindrical brush. The rotary lip may be supported by a pair of arms in a position with the lip lightly engaging or spaced slightly upwardly from the floor surface in a non-sweeping position. The support structure for the rotary lip includes an arm mechanism preferably independently supporting the lip at each end. This arrangement allows the rotary lip to be freely lifted by large debris passing into the zone between the rotary lip and the primary brush and yet permits return of the rotary lip to a position closely adjacent the floor once such material has passed therebetween. Since the rotary lip is driven, it will climb over larger debris such as cans and bottles, pull them into the sweeping chamber and prevent them from being thrown out by the sweeping brush. The arm support structure may be pivotably secured to the sweeper forwardly of the rotary lip. The rotary lip may be at least partially counterbalanced, for example with a spring mechanism, to minimize the effective weight of the lip thereby facilitating movement of larger debris therebeneath. The rotary lip may be rotatably driven by a power source such as a hydraulic motor. The motor may be mounted on one of the arms supporting the rotary lip. The present machine may further include disc type brushes, steering mechanisms and other elements suitable and/or conventional in sweeper or scrubber constructions.

BRIEF DESCRIPTION OF THE DRAWINGS

FIG. I is a perspective view of a riding type sweeper including the present invention;

FIG. II is a schematic side view of one embodiment of the present invention with certain portions broken away to disclose underlying structure;

FIG. II*a* is a view taken along line II*a*—II*a* in FIG. II;

FIG. III is a similar view from the opposite side of the sweeping machine;

FIG. IV is a cross-sectional view of one suitable rotary lip construction;

FIG. V is a cross-sectional view of another rotary lip construction;

FIG. VI is a cross-sectional view of a further rotary lip arrangement;

FIG. VII is a schematic sideview of another embodiment of the present invention;

FIG. VIII is schematic side view of a riding type scrubber embodying the present invention with certain portions broken away to disclose underlying structure; and FIG. IX is a scarifier embodiment of the present invention.

DETAILED DESCRIPTION

A surface maintenance machine 10 according to the present invention, one sweeper embodiment of which is shown in FIGS. I–III, may include a body 11 supported on a plurality of wheels 12. The sweeper 10 has a power source, such as electric motor 13, for driving one or more of the wheels 12. The sweeper 10 may have a cylindrical tool, for example, a brush 14 for lifting debris into a hopper 15. The sweeper 10 may have a curb or side brush 16 for moving dirt and debris away from a curb or wall inwardly toward the center of the machine. The sweeper 10 may be provided with a steering mechanism 17, a seat 18 for an operator and suitble controls 19. The sweeper 10 may include a dust filtering section 21 and a vacuum fan 22 for drawing a partial vacuum in the brush housing 20 around the cylindrical brush 14 thereby minimizing any dusting problems. The fan 22 may be powered by motor 13 and may exhaust to the atmosphere. The housing 20 is shown opening to the front thereby providing for forward throwing of debris.

The cylindrical brush 14 may be supported by a pair of pivotable arms such as 23 and 25 (FIGS. II and III). Brush 14, for example, is rotatably mounted in a bearing 24 at one end of arm 25 and driven by a suitable motor. Arms 23 and 25 may then be pivotally mounted on a shaft 26 adjacent the opposite end of the respective arms 23 and 25. The sweeper 10 may include a control 27 for raising and lowering the brush 14. For example, the brush 14 may be raised when traveling from one sweeping location to another. The brush 14 is then lowered into contact with the floor surface when the actual sweeping begins. The control 27 may also serve to adjust the amount of force present in the engagement of the brush 14 with the floor surface. Control 27 further may be used for adjustment to lower the brush 14 into contact with the surface as wear takes place. Although the present invention is described as having a cylindrical brush, it is to be recognized that other cylindrical tools may be used, for example, a cylindrical scarifier tool as shown in Tennant's U.S. Pat. No. 3,084,367.

The housing 20 may have an arcuate upper wall 45 which extends down close to the brush at an appropriate debris pick off point. As shown in FIG. III this may be at about a one o'clock position. The wall 45 may be carried by a pair of side members 46 and 47 each having a lower cam surface or edge **46*a* and 47*a* and being pivotally mounted at the lower end with respect to the body 11. The upper wall or shroud 45 desirably is adjustable to account for wear of the brush e.g. the wall 45 is moved arcuately downwardly as brush wear takes place. For example, cam followers 48, 49 may be carried by the arms 25 and 23, respectively. The cam followers 48, 49 support side members 46 and 47 as such members pivot toward brush 14 thereby permitting the wall 45 to follow the brush. As wear of brush 14 takes place cam followers 48 and 49** move downwardly.

The sweeper 10 has a rotary lip 30 mounted forwardly of brush 14. The lip 30 includes a cylindrical member 31 which is rotatably supported by arm mechanisms 32 and 33 at either end. The cylindrical member 31 may be a resilient paddle structure, as illustrated in FIG. IV. Desirably the paddles are spaced such that bottles and cans may be trapped between adjacent blades. This facilitates lifting and projecting of such debris into the hopper. Cylindrical member 31 alternatively may be a tube having a resilient outer portion such as a thickened rubber layer or a bristle brush structure. The cylindrical member 31 may extend substantially the full length of brush 14.

The paddle-type rotary lip 31 as shown in FIG. IV has a central support member 31*a* which is rotatably mounted on arms 32 and 33. A pair of elongated resilient blade members 31*b* and 31*c* are secured to support 31*a* by plates 31*d*, 31*e*, 31*f* and 31*g* which are bolted in place. Each blade member 31*b* and 31*c* may carry a pair of blades. The blade members 31*b* and 31*c* may extend substantially the full length of the lip 31. The cylindrical member 31 desirably may have an effective diameter substantially smaller than the diameter of brush 14. The resilient blade members 31*b* and 31*c* may be replaced with strip brushes such as 131*b* and 131*c* as shown in FIG. V. The strip brushes and suitable mounting brackets 131*d* and 131*e* are commercially available. Illustrative strip brushes are Osborn's Master Strip TM. The support member 131*a* may be a metal or resinous extrudate.

A further embodiment, rotary lip 231, is illustrated in FIG. VI. Rotary lip 231 includes a central support member 232 with a plurality of pairs of flanges 233 and 234 mounted thereon. The flanges 233 and 234 together with support 232 form a shaped cavity 235. An extruded strip 236 is mounted in each cavity 235. In other words strip 236 may have a blade like portion 237 with a shaped edge portion 238. The edge portion 238 may be of a shape and size to be snugly received in cavity 235.

The arm structures 32 and 33 (FIGS. II and III) may provide for independent suspension of each end of rotary lip 31. The arm structures 32 and 33 are pivotably mounted at one end to the body 11 such as by ball joints 34, 36 respectively. The arms 32 and 33 extend rearwardly and downwardly from the ball joints 34 and 36 preferably at an angle of 45° or less from the horizontal. The arm structures 32 and 33 may alternatively be locked with respect to each other so that the rotary lip remains parallel to the surface being swept. The arms 32 and 33 are rotatably secured to the lip 31 at the opposite ends. Mechanism 37 is included for driving the lip 31. The driving mechanism 37 may be a hydraulically powered motor or an electrically powered motor mounted on one of the arm structures 32, 33. The arm structures 32 and 33 may have a stop 38, 39 which limits the downward movement of the lip 31 so that the lip 31 desirably very slightly clears the floor surface thus minimizing drag and wear of the lip 31 due to abrasion. The stops 38 and 39 may be adjustable, such as by a screw structure. If desired, counterbalance mechanism may be provided to minimize the effective weight of the rotary lip. The counterbalance mechanism may be a spring 35 extending from the upper portion of housing 20 to lower end of the arms such as arm 33. A cable system 35*a* may interconnect the brush arm such as 25 with the rotary lip arm such as 33 so that raising or lowering of the brush 14 will also simultaneously raise or lower the rotary lip 30.

Resilient flap-type lips 41 and 42 are provided along each end of housing 20 to assist in sealing the housing 20 from the atmosphere for dust control. The lips 41 and 42 are spaced inwardly as closely as feasible to the brush 14, thereby reducing trailing of dirt and debris at the sides of brush 14. In fact lips 41 and 42 may be sloped inwardly to deflect any debris thrown laterally back into the path of the brush. See FIG. II*a*. A rear circulating flap 43 is provided to redirect under brush 14 any debris that is carried over brush 14. A rear skirt 43*a* is provided to seal the back of housing 20 from the atmosphere for dust control.

Although the present description has been directed principally to the brush and rotary lip structure, it is to be recognized that the sweeper 10 may further include various suitable and/or conventional sweeper elements.

OPERATION OF THE PRESENT INVENTION

The operator may place sweeper 10 in use in a manner very similar to previous sweeper units. The sweeper 10 is placed in operation, for example, by starting the gasoline engine or switching on the electric motor 13. Power is thereby transmitted to brush 14 and wheels such as 12. The operator may control the forward movement and the rotatable operation of the brushes 14 and 16 such as by engagement of the control mechanism 19. The motor 13 may also serve to drive the fan 22 thereby providing a negative pressure in housing 20 adjacent the brush 14. The operator may direct the sweeper 10 along the desired path utilizing the steering mechanism 17. Dirt and debris may pass beneath the rotary lip 31 until contacted by brush 14. The dirt and debris are gathered inwardly by rotating lip 31 and projected forwardly and upwardly between the lip 31 and brush 14. The dirt and debris are projected in a path which is generally tangential to the lip 31 and brush 14. Each end of the rotary lip 31 is shown independently supported. Thus if one end of the lip 31 encounters a larger piece of debris such as a bottle or can and is raised, the other end may remain closely adjacent the surface. This minimizes forward projection of debris by the brush 14. Alternatively, the two arms may operate in unison so that lip 31 remains at all times angularly fixed e.g. parallel with respect to the floor surface. Lip 31 is rotating in a direction opposite to that of brush 14 as shown by the arrows in FIG. II, to lift and project debris into the hopper 15. The dirt and debris are forcibly projected into hopper 15. Large pieces of debris such as tin cans and small debris such as dirt particles both may move between lip 31 and brush 14 and be projected into the hopper. The operator may adjust control 27 to provide the appropriate degree of engagement between brush 14 and the floor surface. Also the stops 38 and 39 may be appropriately adjusted so that rotary lip 31 very lightly contacts or just clears the surface being swept. The hopper 15, of course, may be emptied of dirt and debris when necessary and/or desired.

ALTERNATE EMBODIMENT

An alternate embodiment 110 of the present invention is shown in FIG. VII. Machine 110 may be similar in overall structure to that of machine 10; however, the cylindrical brush 114 is located at the forward most portion of the structure. The brush 114 is shown supported by pivotable arms 123 and may be suitably driven such as by an electric motor. A rotary lip 111 cooperates with brush 114 to seal the forward side of the brush housing 120. The rotary lip 111 assists brush 114 in projecting debris upwardly and rearwardly over brush 114 into hopper 115. The rotary lip 111 may be supported by a pair of pivotable arms 132. The arms 132 may have an adjustable stop 134 which engages a bracket 135 on the frame to limit the downward movement of the lip 111 so that the lip very slightly clears the floor surface, as stated before in connection with FIG. II. Although the rotary lip and brush is shown in the forward portion of the machine 110, it is to be recognized that the lip and brush may be in the mid portion or even rear portion of the machine 110. The machine 110 operates in a manner similar to machine 10. Machine 110 is particularly advantageous in use situations where the machine is driven up to a pile of debris and the pile is loaded into the hopper. It is to be recognized that various other changes and modifications may be made without departing from the broader scope of the present invention.

A FURTHER ALTERNATE EMBODIMENT

A further embodiment of the present invention, scrubber 210, is shown in FIGURE VIII. The scrubber 210 may be, in general, similar to previous scrubbers having cylindrical brushes except that scrubber 210 has a power driven rotary lip 230. Scrubber 210 has a body 211 supported on a plurality of wheels 212. The scrubber 210 is driven by a suitable electric motor or an internal combustion engine. The body 211 carries a solution recovery tank 213 connected to a vcauumized squeegee 214 by suitable conduits 224. The tank 213 and squeegee 214 are vacuumized by fan 215. Body 211 also carries a clean solution tank 216 which feeds scrubbing solution through ducts 217 to the surface being scrubbed. The scrubber 210 has a cylindrical brush 218 for working the solution on the floor surface. Brush 218 may be driven by a hydraulic motor 219. Scrubber 210 has a power driven rotary lip 230 for lifting scrubbing solution and debris into debris hopper 223. The rotary lip 230 may be driven by hydraulic motor 222.

Scrubber 210 operates in a manner similar to previous scrubbers except for the function of rotary lip 230. Scrubbing solution from tank 216 is carried through duct 217 and deposited on the floor surface. The brush 218 works the solution on the floor to loosen and lift soilage and debris. The brush 218 throws dirty solution, soilage and debris upwardly and forwardly to the rotating lip 230 which in turn moves the dirty solution, soilage and debris into the debris hopper 223. Solution is drawn from hopper 223 to tank 213 through duct 224*a*. The squeegee 214 picks up most of the remaining solution leaving a substantially dry clean surface free of debris.

The scarifier embodiment of the present invention is shown in FIG. IX. The scarifier 310 is similar in structure to machine 110, however, the cylindrical brush 114 is replaced with a cylindrical scarifier tool 314 supported on arm 323. A housing 320 surrounds the rotary lip 311 and the scarifying tool 314. The scarifier 310 includes a hopper 315 for receipt of debris. The scarifier tool 314 may be of the type shown in U.S. Pat. No. 3,084,367.

What is claimed is:

1. A sweeper comprising a body including a debris hopper, a power source, means for moving the sweeper along a surface, a driven cylindrically shaped brush for sweeping debris into said hopper, a rotary lip associated with said brush, means for rotatably driving said brush to assist in moving said debris into said hopper, said rotary lip being supported by arm means in a position spaced above the surface to be swept, said rotary lip support arm means being adapted to permit vertical movement of said rotary lip, thereby permitting movement of large debris pieces beneath said rotary lip, said support arm means comprising a pair of arm structures, one arm structure being disposed at either end of said rotary lip, said arm structures each being mounted with respect to the sweeper body by a ball and socket structure.

2. In a surface maintenance device, a frame adapted to be moved over a surface to be maintained, a rotatably mounted cylindrical brush on the frame rotated bottomside forward in the direction of travel for working on the surface to be maintained, a storage hopper on the frame for receiving material from the brush, a rotary lip on the frame ahead of the brush in the direction of travel rotated bottomside rearward and adjacent thereto to assist the brush in projecting material into the hopper, the rotary lip being substantially smaller in diameter than the cylindrical brush, means for mounting the rotary lip so that it may move freely in a vertical direction between upper and lower positions, and a stop on the frame defining the lower position of the rotary lip, the rotary lip being adjacent to the surface but applying substantially no load to the surface at all times when in its lower position and being sufficiently spaced from the surface in its upper position so that large pieces of debris may move under it.

3. The structure of claim 2 further characterized in that the mounting means for the rotary lip includes an arm on each side thereof pivoted at one end to the frame and rotatably attached at the other end to the rotary lip.

4. The structure of claim 3 further characterized in that the arms independently support each end of the rotary lip for independent movement relative to the other end.

5. The structure of claim 2 further characterized in that the stop for setting the lower position of the rotary lip is adjustable so that the rotary lip may be accurately positioned relative to the surface.

6. The structure of claim 2 further characterized in that the device is a sweeper.

7. The structure of claim 2 further characterized in that the device is a scarifier.

8. The structure of claim 2 further characterized in that the device is a scrubber.

9. The structure of claim 2 further characterized in that the storage hopper on the frame is positioned rearwardly of the brush in the direction of travel of the machine.

10. The structure of claim 2 further characterized in that the storage hopper on the frame is positioned forwardly of the brush in the direction of travel of the machine.

11. The structure of claim 2 further characterized in that the mounting means for the rotary lip includes means for counterbalancing the rotary lip thereby minimizing its effective weight.

12. The structure of claim 2 further characterized in that the mounting means for the rotary lip is constructed and arranged so that each end of the rotary lip is independently supported for independent movement relative to each other.

13. In a machine for maintaining a surface, a frame constructed to be moved over a surface to be maintained, a rotatably mounted cylindrical brush on the frame for propelling debris from the surface, the brush being movably mounted so that it can be lowered in response to wear, a hopper on the frame for receiving debris propelled by the brush, the frame having a movable laterally disposed upper wall an edge of which closely approaches an upper portion of the rotary brush to thereby define a debris confining baffle, and control means on the brush mounting means for controlling the movement of the upper wall so that as the brush diminishes in size due to wear and is lowered, the upper wall will move to maintain the edge thereof nearest to the brush in approximately constant relationship to the periphery of the brush, the control means including a cam and cam follower so that the movement of the upper wall may be tailored to the movement of the brush.

14. The structure of claim 13 further characterized by and including a rotary lip on the frame ahead of the brush in the direction of travel and adjacent thereto to assist the brush in projecting material into the hopper.

15. In a machine for maintaining a surface, a frame, a generally rotatably mounted cylindrical brush on the frame for propelling debris from the surface, a hopper on the frame for receiving debris propelled by the brush, a vacuum system on the machine to minimize dusting, and a pair of side skirts on the frame on each side of the brush, the side skirts being disposed downwardly and inwardly on opposite sides of the brush with the lower edge of each side skirt approaching the surface to be maintained and near to but out of contact with the brush so as to confine the debris propelled by the brush substantially within the width of the brush.

16. The structure of claim 15 further characterized by and including a rotary lip on the frame ahead of the brush in the direction of travel and adjacent thereto to assist the brush in projecting material into the hopper.

* * * * *